United States Patent [19]

Poor

[11] Patent Number: 4,993,242

[45] Date of Patent: Feb. 19, 1991

[54] CLEANING AID FOR DYEING APPARATUS

[75] Inventor: Kyle W. Poor, Spartanburg, S.C.

[73] Assignee: Milliken Research Corporation, Spartanburg, S.C.

[21] Appl. No.: 544,813

[22] Filed: Jun. 27, 1990

Related U.S. Application Data

[63] Continuation of Ser. No. 423,633, Oct. 18, 1989, abandoned.

[51] Int. Cl.[5] ..... D06B 3/04

[52] U.S. Cl. ..... 68/13 R; 68/62; 68/205 R; 118/697

[58] Field of Search ..... 68/62, 13 R, 200, 205 R; 118/697

[56] References Cited

U.S. PATENT DOCUMENTS

| | | | |
|---|---|---|---|
| 3,393,411 | 7/1968 | McElveen | 8/151 |
| 3,683,649 | 8/1972 | Takriti et al. | 68/5 D |
| 3,688,530 | 9/1972 | Harris et al. | 68/205 R |
| 3,731,503 | 5/1973 | Appenzeller et al. | 68/205 R |
| 3,892,109 | 7/1975 | Klein et al. | 68/205 R |
| 3,894,413 | 7/1975 | Johnson | 68/205 R |
| 3,937,045 | 2/1976 | Klein et al. | 68/205 R |
| 3,939,675 | 2/1976 | Klein | 68/205 R |
| 3,942,342 | 3/1976 | Klein et al. | 68/205 R |
| 3,942,343 | 3/1976 | Klein | 68/205 R |
| 3,969,779 | 7/1976 | Stewart, Jr. | 8/149 |
| 3,985,006 | 10/1976 | Klein | 68/205 R |
| 4,019,352 | 4/1977 | McCollough, Jr. et al. | 68/205 R |
| 4,033,153 | 7/1977 | Ahrweiler | 68/205 R |
| 4,033,154 | 7/1977 | Johnson | 68/205 R |
| 4,034,584 | 7/1977 | Klein et al. | 68/205 R |
| 4,055,868 | 11/1977 | O'Neill, Jr. | 8/150 |
| 4,058,991 | 11/1977 | McCollough | 68/205 R |
| 4,059,880 | 11/1977 | Klein | 29/157 |
| 4,095,444 | 6/1978 | Pascoe, Sr. et al. | 68/205 R |
| 4,097,946 | 7/1978 | McCollough | 8/150 |
| 4,116,626 | 9/1978 | Varner | 8/149 |
| 4,148,668 | 4/1979 | Stewart, Jr. | 134/22 C |
| 4,202,189 | 5/1980 | Addis et al. | 68/205 R |
| 4,254,644 | 3/1981 | Bartlett et al. | 68/205 R |
| 4,377,080 | 3/1983 | Fox | 68/205 R |
| 4,392,366 | 7/1983 | Godfrey | 68/205 R |
| 4,433,811 | 2/1984 | Godfrey | 239/74 |
| 4,434,632 | 3/1984 | McCollough, Jr. et al. | 68/205 R |
| 4,584,854 | 4/1986 | King | 68/205 R |
| 4,648,250 | 3/1987 | Yabe | 68/5 D |

FOREIGN PATENT DOCUMENTS

| | | |
|---|---|---|
| 0061176 | 9/1982 | European Pat. Off. . |
| 978452 | 12/1964 | United Kingdom . |
| 1201598 | 8/1970 | United Kingdom . |

*Primary Examiner*—Frankie L. Stinson

*Attorney, Agent, or Firm*—Kevin M. Kercher; H. William Petry

[57] ABSTRACT

A moveable shield and associated liquid containment system which may be used with machines in which arrays of individual streams of liquid dye are used to pattern substrates. The shield associated with a given array selectively may be interposed between the substrate and the liquid dye streams of that array to prevent substrate contact by the liquid streams as, for example, during cleaning operations, or withdrawn to permit unimpeded substrate contact by the liquid dye stream. One or more arrays may be cleaned or charged with a different color dyestuff while the remaining arrays are used to pattern the substrate, eliminating the down time presently associated with the cleaning or dye changing of individual arrays.

7 Claims, 9 Drawing Sheets

CLEANING AID FOR DYEING APPARATUS

This application is a continuation of Ser. No. 423,846, now abandoned which is a continuation of Ser. No. 226,643 filed on Oct. 18, 1987, now abandoned.

This invention relates to an apparatus for the application of dyestuffs to textile materials, and, more particularly, to a device useful in cleaning the dye-emitting orifices and other dye handling parts associated with such apparatus.

Many techniques are known for the application of dyestuffs to textile substrates, and particularly the application of dyestuffs to such substrates in a pattern configuration. Among such techniques, it has been found advantageous to apply dye in the form of discrete streams of dye, formed and directed by a plurality of dye-emitting orifices. Ideally, each individual stream may be intermittently interrupted or diverted in accordance with pattern information. Dyeing systems of this latter type are generally described in greater detail in, for example, U.S. Pat. Nos. 3,894,413, 3,942,343, 4,033,154, 4,034,584, 4,116,626, 4,309,881, 4,434,632, and 4,584,854.

These systems are commonly configured in the form of a conveyor which transports the substrate to be dyed under a plurality of such continuously flowing discrete dye streams. In a preferred embodiment, a plurality of dye orifices, each directed at the substrate, are arranged in several individual linear arrays positioned generally above and across the substrate path in spaced, parallel alignment, with each array being associated with a separate source (e.g., a different color) of liquid dye. Generally, each of the arrays is positioned in close proximity to the substrate to be dyed, with typical clearance between the array and the substrate surface being substantially less than one inch. The individual continuously flowing dye streams in a given array are normally directed onto the substrate surface. However, by means of a transverse intersecting stream of diverting air which is aligned with each dye stream and which is actuated or interrupted in response to externally supplied pattern information, the continuously flowing stream may be directed into a collection chamber or catch basin so as to prevent any dye from contacting the substrate.

To accurately control the amount of dye applied to a given location on the material during the dyeing operation, and to insure that the dye strikes the material in a very small, precise spot, the lower portion of the collection chamber contains a collector plate supportably positioned in spaced relation above the lower wall of the collection chamber. This collector plate is adjustably attached to the lower wall of the collection chamber by way of an elongate collector plate support member which forms an extension of the lower wall of the collection chamber. By means of careful adjustment of the position of the collector plate relative to the collector plate support member, the leading edge of the collector plate can be accurately positioned relative to the dye discharge axes of the array to insure prompt and precise interception of the streams when deflected. Details of such a dyeing apparatus and collection chamber construction are described and claimed in commonly assigned U.S. Pat. No. 3,942,343, referenced above. As described therein, each dye stream, when deflected, passes across the edge of the collector plate and into the collection chamber. Upon removal of the deflecting air stream, the stream moves back across the plate edge and resumes its normal path of travel toward the material to be dyed.

Because each array may be supplied with a different dye stuff, dye of different colors from several of the individual arrays may be directed onto the same area of the substrate and blended on the substrate to produce a wide variety of colors and patterns. One inherent difficulty in such systems involves changing the dye in one or more of the individual arrays to permit patterning using a different color or set of colors. All of the previous dye in the array must be thoroughly purged from the apparatus prior to the introduction of the newly selected dye to prevent undesirable shade changing of the newly selected dye.

This process usually involves the emptying of the dye reservoir and manifold associated with the chosen array, followed by a flushing operation in which water is used as the working liquid rather than dye. Additionally, sprays of water may be directed within the array to cleanse all surfaces exposed to the previously used dye. After the flush water reaches an acceptable level of residual dye content, the flushing operation may be stopped and the newly selected dye introduced. This process has heretofore required the entire dyeing operation to be halted and the substrate removed from the apparatus to avoid staining of the substrate by the flush water, even if only one of the arrays required a color change.

Another inherent difficulty in such systems involves the partial or complete blockage of one or more of the dye-emitting orifices in a given array. When such blockages occur, the dye stream cannot deposit the required quantity or configuration of dye on the substrate in response to the pattern information, and an undesired pattern anomaly results.

Previous efforts to clean such orifices have met with limited success. For example, U.S. Pat. Nos. 3,892,109 and 4,148,668 disclose a cleaning approach in which an array of jet washers may be mounted in a carriage arrangement which permits the individual washers to be manually positioned opposite, and in axial alignment with, the dye-emitting orifices. Pressurized water or other fluid may then be directed from the washer orifices into the dye orifices, dislodging and removing any obstructions within the orifices. This method can be used to clean multiple arrays of orifices in a single pass of the wash carriage, but requires the substrate to be moved away from the arrays to provide proper clearance for the carriage between the arrays and the substrate surface. This interrupts any dyeing or patterning operation, and, because of the resulting flow of dye-carrying rinse water falling from the array onto the substrate, usually results in the permanent soiling of that section of substrate under the arrays at the time of cleaning.

A less comprehensive, but simpler technique is to clear the individual dye orifices by inserting a wire or the like into the orifice bore. However, this technique also requires the substrate to be moved away from the arrays in order to gain access to the dye orifice, and thereby halts any dyeing or patterning operation.

As noted above, either of the above methods requires an increase in the array-to-substrate spacing in order to accommodate the cleaning means. This requires the entire dyeing operation to be halted for cleaning, even though a blockage may have occurred in only one array of a multiple array apparatus.

The invention disclosed herein comprises an improvement over such existing techniques in that an individual array may be cleaned or supplied with a change of dye while all other arrays associated with the apparatus remain in operation. No increase in the array-to-substrate spacing is required. The invention disclosed herein also provides for both external and internal cleaning of the array. Additionally, the invention disclosed herein prevents any soiling of the substrate as a result of such cleaning or dye changing operation.

These advantages are achieved through the use of a novel cleaning device whereby a shutter or shield, positioned on a containment enclosure comprising a part of the array, is removably interposed between the dye-emitting orifices and the substrate while water is sprayed and circulated within the array for the purpose of cleaning and unblocking the orifices as well as cleaning and preparing all dye-contacting surfaces within the array for receiving dye of a different color. The shield and containment enclosure of this invention are designed to keep any washing liquid from contacting the substrate.

Additional advantages and details of the novel containment apparatus having a moveable shutter which comprises the instant invention will be better appreciated and understood following a reading of the detailed description below, when read in conjunction with the accompanying Figures, in which.

Figure 1:
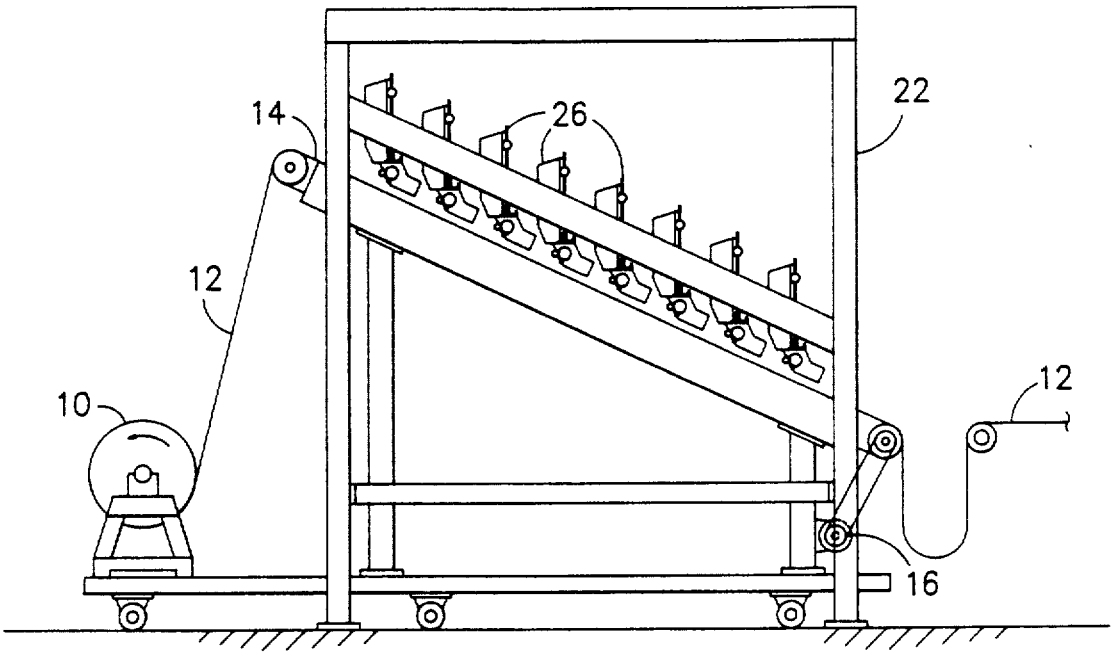
FIG. 1 is a diagrammatic side view of the array configuration of a dyeing apparatus of a kind for which the instant invention may be adapted, depicting eight dye-emitting arrays positioned above a section of a substrate web to be patterned.

FIG. 1 depicts, in a side elevation view, a set of eight individual arrays 26 positioned within frame 22. These arrays form part of a pattern dyeing machine to which the present invention is particularly suited. Each array 26 is comprised of a plurality of dye jets, arranged in spaced alignment, which extend generally above and across the width of substrate 12. Substrate 12 is supplied from roll 10 and is transported in turn under each array 26 by conveyor 14 driven by a suitable motor indicated generally at 16. After being transported under arrays 26, substrate 12 may be passed through other dyeing-related process steps such as drying, fixing, etc.

Figure 2:
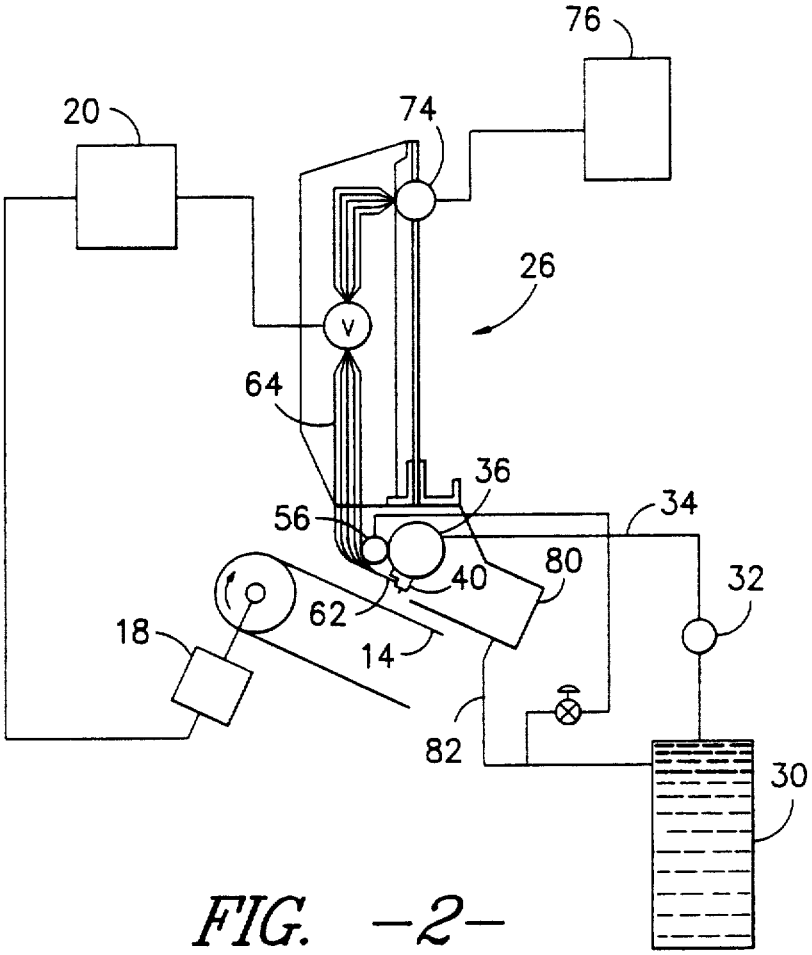
FIG. 2 is a schematicized diagram of a portion of the apparatus of FIG. 1.

FIG. 2 depicts, in schematic form, a side elevation of one dye-emitting array of the machine of FIG. 1. For each such array shown generally at 26, a separate dye reservoir tank 30 supplies liquid dye under pressure, by means of pump 32 and dye supply conduit means 34, to a primary dye manifold assembly 36 of the array. Primary manifold assembly 36 communicates with and supplies dye to dye sub-manifold assembly 40 (shown in greater detail in FIGS. 5 and 6) at suitable locations along their respective lengths. Both manifold assembly 36 and sub-manifold assembly 40 extend across the width of conveyor 14 on which the substrate to be dyed is transported. Sub-manifold assembly 40 is provided with a plurality of spaced, generally downwardly directed dye passage outlets 52 (shown, e.g., in FIG. 6) positioned across the width of conveyor 14 which produce a plurality of parallel dye streams which are directed onto the substrate surface to be patterned.

Figure 6:
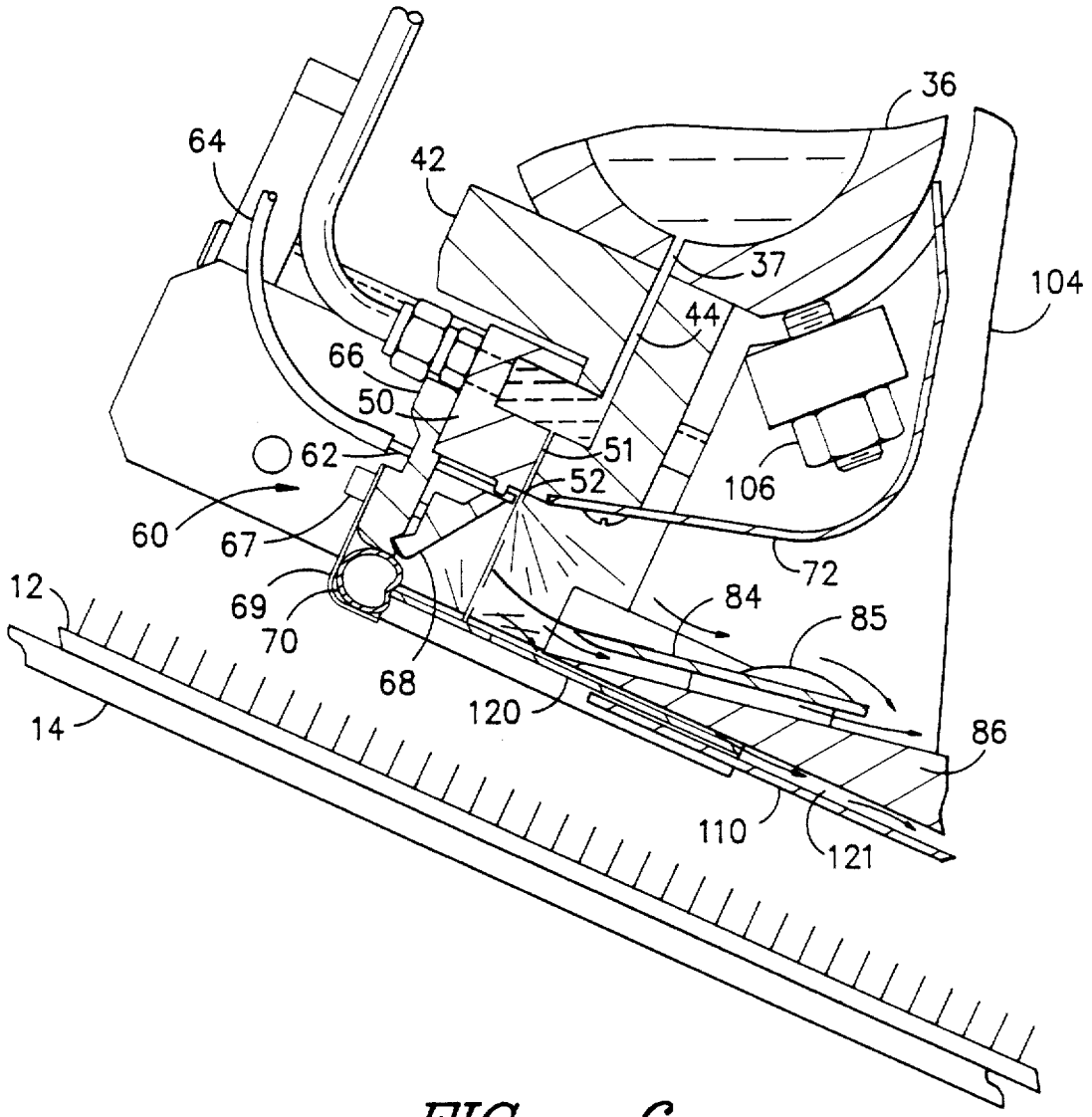
FIG. 6 is a further enlargement of a portion of the view of FIG. 5.
Figure 7:
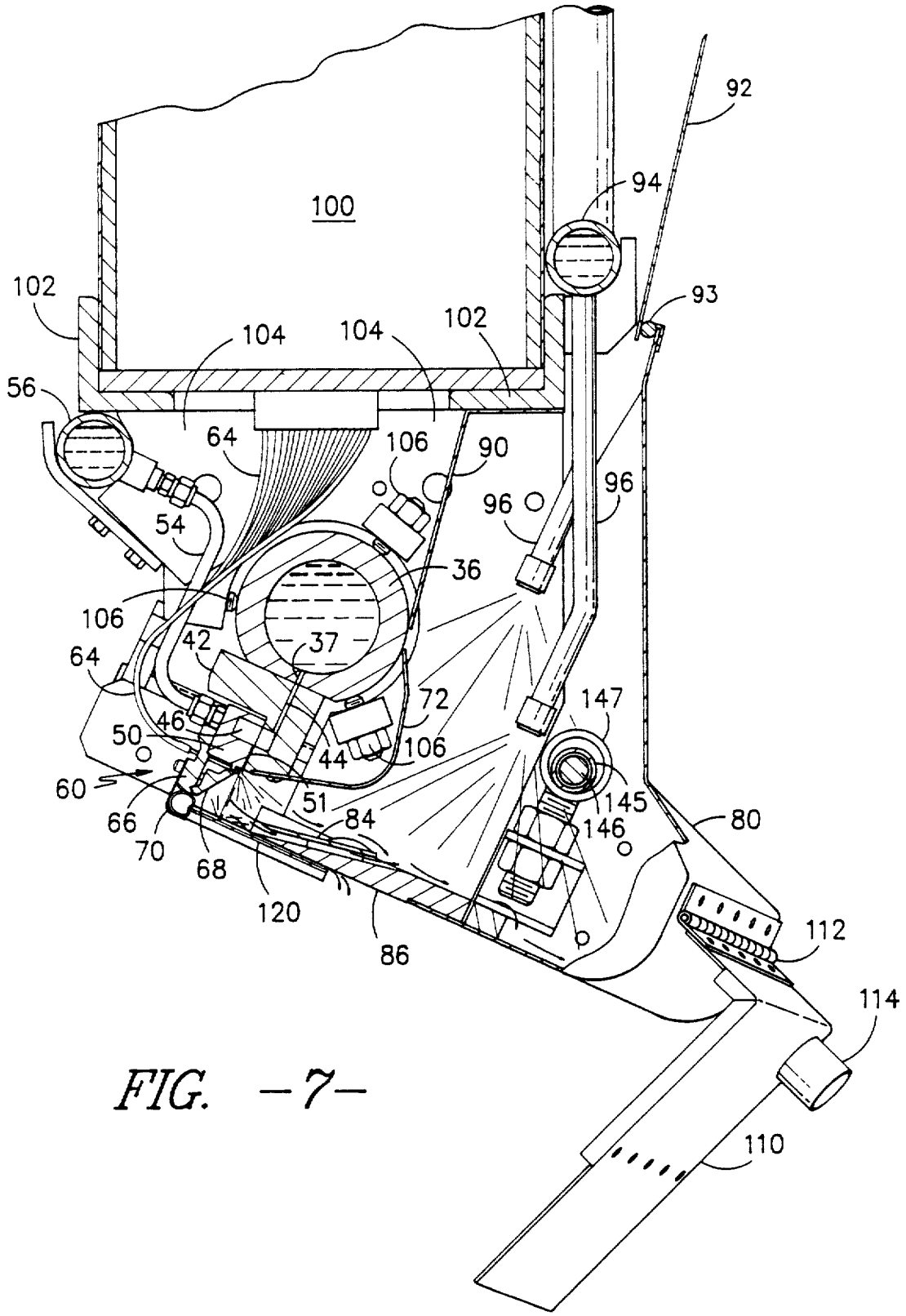
FIG. 7 shows the array of FIG. 5 with the secondary drain tray in a lowered position, as for occasional maintenance.
Figure 8:
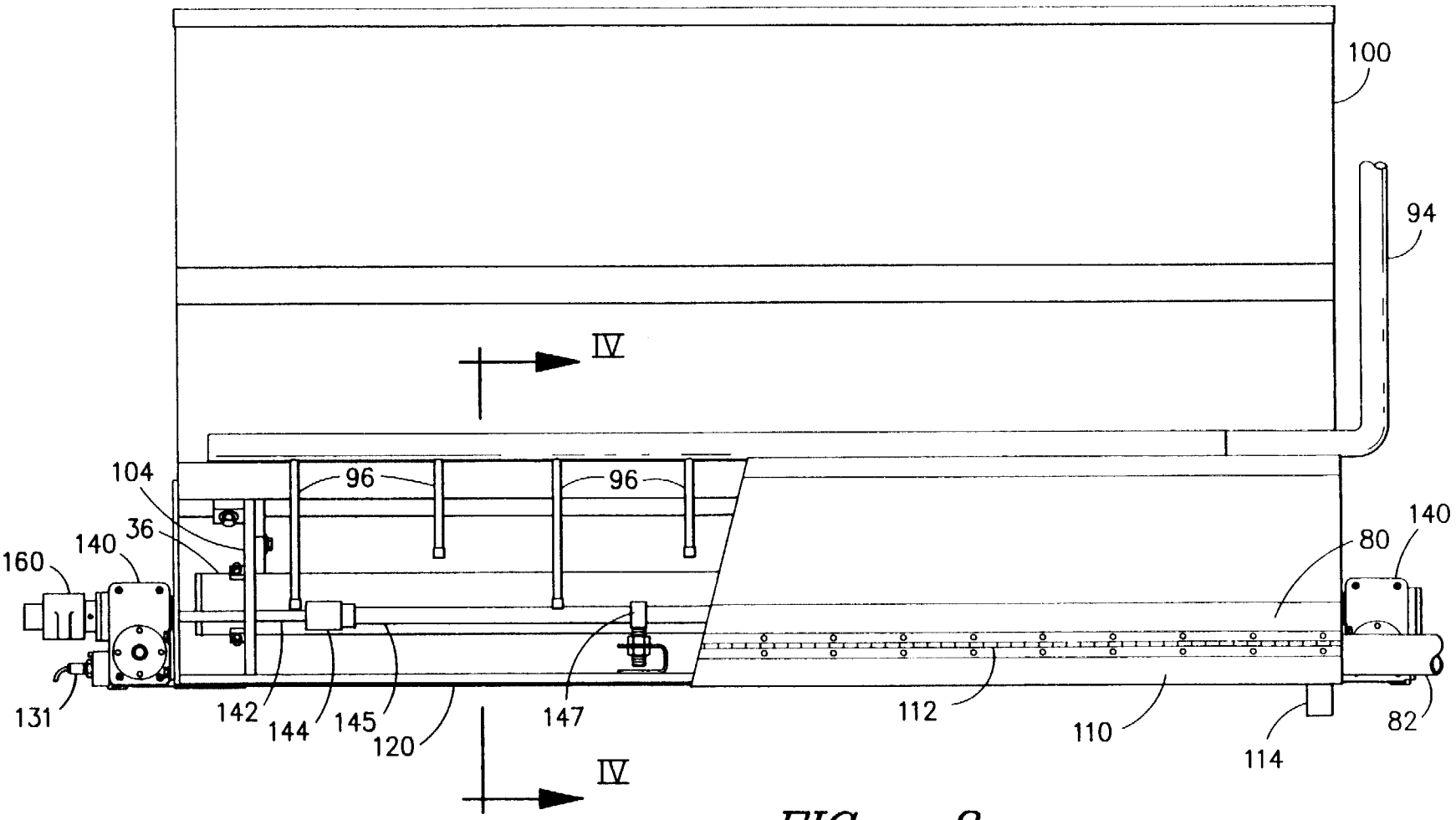
FIG. 8 shows, in partial section, a rear view (i.e., view looking from right to left in FIG. 5) of the shutter/containment apparatus of the instant invention.

As shown in FIGS. 2 and 6, positioned in alignment with and approximately perpendicular to each dye passage outlet 52 in sub-manifold assembly 40 is the outlet of an air deflection tube 62. Each tube 62 communicates by way of an air deflection conduit 64 with an individual air valve, illustrated collectively at "V" in FIG. 2, which valve selectively interrupts the flow of air to air tube 62 in accordance with pattern information supplied by pattern control device 20. Each valve is, in turn, connected by an air supply conduit to a pressurized air supply manifold 74 which is provided with pressurized air by air compressor 76. Each of the valves V, which may be of the electromagnetic solenoid type, are individually controlled by electrical signals from a pattern control device 20. The outlets of deflection tubes 62 direct streams of air which are aligned with and impinge against the continuously flowing streams of dye flowing from dye passage outlets 52 and deflect such dye streams into a primary collection chamber or trough 80, from which liquid dye may be removed, by means of a suitable dye collection conduit means 82, to dye reservoir tank 30 for recirculation.

The pattern control device 20 for operating solenoid valves V may be comprised of various pattern control means, such as a computer with pattern information storage capabilities. Desired pattern information from control device 20 is transmitted to the solenoid valves of each array at appropriate times in response to movement by conveyor 14 which is detected by suitable rotary motion sensor or transducer means 18 operatively associated with the conveyor 14 and connected to control device 20. Details of one means to perform this function may be found in commonly assigned U.S.

Pat. No. 4,033,154, issued July 5, 1977, which disclosure is hereby incorporated by reference.

In a typical dyeing operation utilizing such apparatus, so long as no pattern information is supplied by control device 20 to the air valves V associated with the array of dye outlets 52, the valves remain "open" to permit passage of pressurized air from air manifold 74 through air supply conduits 64 to continuously deflect all of the continuously flowing dye streams from the dye outlets 52 into the primary collection chamber 80 for recirculation. When the substrate 12 initially passes beneath the dye outlets 52 of the individual arrays 26, pattern control device 20 is actuated in suitable manner, such as manually by an operator. Thereafter, signals from transducer 18 prompt pattern information from pattern control device 20. As dictated by the pattern information, pattern control device 20 generates control signals to selectively "close" appropriate air valves so that, in accordance with the desired pattern, deflecting air streams at specified individual dye outlets 52 along the arrays 26 are interrupted and the corresponding dye streams are not deflected, but instead are allowed to continue along their normal discharge paths to strike the substrate 12. Thus, by operating the solenoid air valves of each array in the desired pattern sequence, a colored pattern of dye is placed on the substrate during its passage under the respective array.

FIGS. 3 through 7 depict end views, in partial or full section, of the arrays 26 of FIGS. 1 and 2 which are equipped with the invention disclosed herein. Individual support beams 102 for each array 26 extend across conveyor 14 and are attached at each end to diagonal frame members 24. Perpendicularly affixed at spaced locations along individual support beams 102 are plate-like mounting brackets 104, which provide support for primary dye manifold assembly 36 and associated apparatus, primary dye collection chamber 80 and associated apparatus, and the apparatus associated with the instant invention. In a preferred embodiment, valve boxes 100, supported by beams 102, may be used to house collectively the plurality of individual valves V, as well as the air manifold 74 associated with each array.

As depicted most clearly in FIGS. 4 through 7, primary dye manifold assembly 36 is comprised of a pipe having a flat mating surface which accommodates a corresponding mating surface on sub-manifold assembly 40. Sub-manifold assembly 40 is comprised of sub-manifold module section 42, grooved dye outlet module 50, and an elongate sub-manifold 46 cooperatively formed by elongate mating channels in sub-manifold section 42 and outlet module 50. Sub-manifold module 42 is attached to primary dye manifold assembly 36 by bolts (not shown) or other suitable means so that drilled outlet conduits 37 in the mating surface of manifold assembly 36 and corresponding drilled passages 44 in the mating surface of sub-manifold module section 42 are aligned, thereby permitting pressurized liquid dye to flow from the interior of manifold assembly 36 to elongate sub-manifold 46.

Associated with the mating face of dye outlet module 50 are a plurality of grooves or channels 51 which, when dye outlet module 50 is mated to sub-manifold module 42 as by bolts or other appropriate means (not shown), form dye passage outlets 52 through which uniform quantities of liquid dye from sub-manifold 46 may be directed onto the substrate in the form of aligned, parallel streams. The relative position or alignment of dye channels 51 with respect to primary dye collector plate 84 and collector plate support member 86 may be adjusted by appropriate rotation of jacking screws 106 associated with mounting brackets 104.

Associated with dye outlet module 50 is deflecting air jet assembly 60, shown most clearly in FIG. 6, by which individual streams of air from air tubes 62 may be selectively directed, via an array of valves in valve box 100 and connecting supply conduits 64, across the path of respective dye streams. Assembly 60 is comprised of an air supply tube support plate 66 and air tube clamp 68, intended to align and secure individual air deflecting tubes 62 immediately outside dye outlets 52. By rotating air tube clamp screw 67, the pressure exerted by clamp 68 on air tubes 62 may be adjusted. Airfoil 72, positioned generally opposite air tubes 62, is intended to reduce the degree of turbulence within the region of the array due to the action of the transverse air streams issuing from tubes 62. Although not shown, the protruding portion of dye outlet module 50 against which air tube clamp 68 urges tubes 62 is preferably configured with a series of vee-shaped notches into which tubes 62 may partially be recessed. Further details of a similar alignment arrangement may be found in commonly assigned U.S. Pat. No. 4,309,881.

Figure 5:
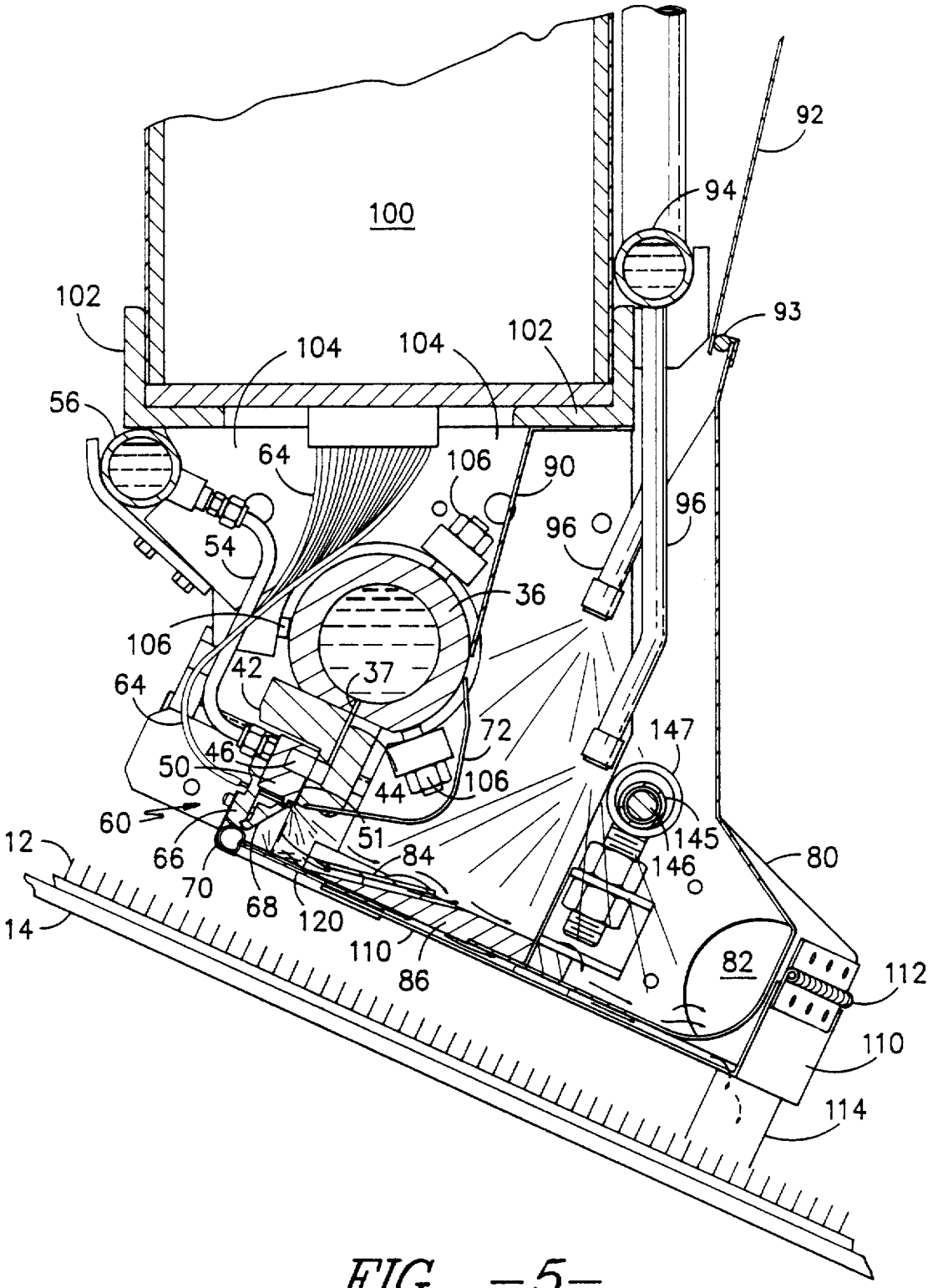
FIG. 5 is an enlarged view of the right array of FIG. 4, detailing the presumed flow of water within the array during the cleaning operation and showing such flow around the engaged or interposed shutter portion of the present invention.

Also associated with dye outlet module 50 is dye by-pass manifold 56 and by-pass manifold conduit 54, shown most clearly in FIG. 5, which collectively act as a pressure ballast and provides for a uniformly pressurized dye supply within sub-manifold 46.

When the liquid dye stream is deflected, the liquid dye exiting from dye passage outlets 52 is directed into primary dye collector chamber 80, which may be formed of suitable sheet material such as stainless steel and extends along the length of the array 26. Associated with collection chamber 80 is a primary dye collector plate 84 which is comprised of a thin flexible blade-like member which is positioned parallel and closely adjacent to dye passage outlets 52. Primary collector plate 84 may be adjustably attached at spaced locations along its length, as by bolt and spacer means 85, to wedge-shaped elongate collector plate support member 86, which forms an extension of the floor of primary collection chamber 80 and which is sharpened along the edge nearest the outlets 52 of dye discharge channels 51 and extends along the length of array 26. Any suitable adjustment means by which a thin, blade-like collector plate 84 may be mounted under tension along its length and aligned with the axes of dye outlet module grooves 51 may be employed; one such means is disclosed in commonly assigned U.S. Pat. No. 4,202,189.

As shown in FIG. 5, primary dye collection chamber 80 is positioned generally opposite the array of air deflection tubes 62 for the purpose of collecting liquid dye which has been diverted from the dye streams by the transverse air stream from tubes 62. Primary dye collection chamber 80 also captures and collects partially diverted water sprayed at high pressure from manifold assembly 36, as well as water sprayed from staggered cleaning water nozzles 96 associated with wash water manifold 94, whenever the array is cleaned, e.g., when use of a different color dye is to be used. Primary dye collection chamber 80 may be attached by conventional means to mounting brackets 104 as well as to sharpened collector plate support member 86, which may be rabbeted to accommodate the floor of chamber 80, as shown, and forms a cavity into which dye or wash water may be collected and removed from the interior of the array via primary dye collection conduit 82. Mist shield 90, which generally extends the length of the array, is attached to the bottom of the valve box 100 using bolts or other suitable means, not shown. Shield 90 prevents wash water or dye, either in the form of droplets or airborne mist, from traveling between the manifold 36 and the valve box 100 and dripping onto and staining the substrate from that side of the array. Mist shield 92, also attached to valve box 100, uses spring force to compress elastomeric seal 93 which is attached to the dye collection chamber 80. Shield 92 and seal 93 prevent wash water, primarily in the form of airborne mist, from exiting the top of the dye collection chamber 80 and settling onto the substrate below. Both shields 90 and 92 and dye collection chamber 80 are preferably open at both ends so as to allow the pressurized air from air deflection tubes 62 to escape without undue restriction.

A principal component of the instant invention, secondary drain tray 110 extends along the length of primary dye collection chamber tray 80 and is attached thereto by means of hinge 112, which allows secondary drain tray 110 to swing away from the underside of array 26 for occasional cleaning and maintenance. When in position under array 26, secondary drain tray 110 may be secured through apertures (shown in FIG. 7) in the underside of tray 110 which are aligned with corresponding holes (not shown) in the primary dye collection chamber 80 by means of bolts or other suitable means, not shown. A fixed distance is held between the secondary drain tray 110 and primary dye collection chamber 80 through use of spacers. Liquid collected by secondary drain tray 110 may be collected by gravity and discharged through drain pipe 114, as indicated in FIG. 5. This liquid is transported through a suitable conduit to a waste water drain.

Associated with the unhinged end of secondary drain tray 110 is movable shutter or shield 120, which is comprised of a thin elongate plate to which, in a preferred embodiment, tension is applied in a lengthwise direction in order to reduce sag and assure proper alignment and fit. Such tension may be introduced by a series of spring washers, as shown at 124 in FIG. 10, similar to the means by which collector plate 84 may be tensioned. As best shown in FIG. 6, shield 120 is positioned to move freely within the elongate gap 121 between the inside surface of secondary drain tray 110 and the lower surface of primary dye collector plate support member 86. When in an extended position, as when a cleaning operation is underway, the leading edge of shield 120 abuts tubular seal 70 in liquid-tight association. Seal 70 may be affixed to air tube support plate 66 via seal bracket 69, and air tube clamp screw 67. The trailing edge of shield 120 remains within gap 121 to an extent sufficient to assure that liquid flowing along the surface of shield 120 and under collector plate support member 86 towards the trailing edge of shield 120 must continue to flow within gap 121 and along the inside surface of secondary drain tray 110 toward hinge 112, and not flow between shield 120 and tray 110 and thereby onto the substrate 12. When the cleaning operation is completed and liquid dye is again to be directed onto the substrate, shield 120 is moved to a position substantially totally within gap 121 formed by the inside surface of secondary drain tray 110 and collector plate support member 86, as depicted in the left hand array of FIGS. 3 and 4.

Figure 9:
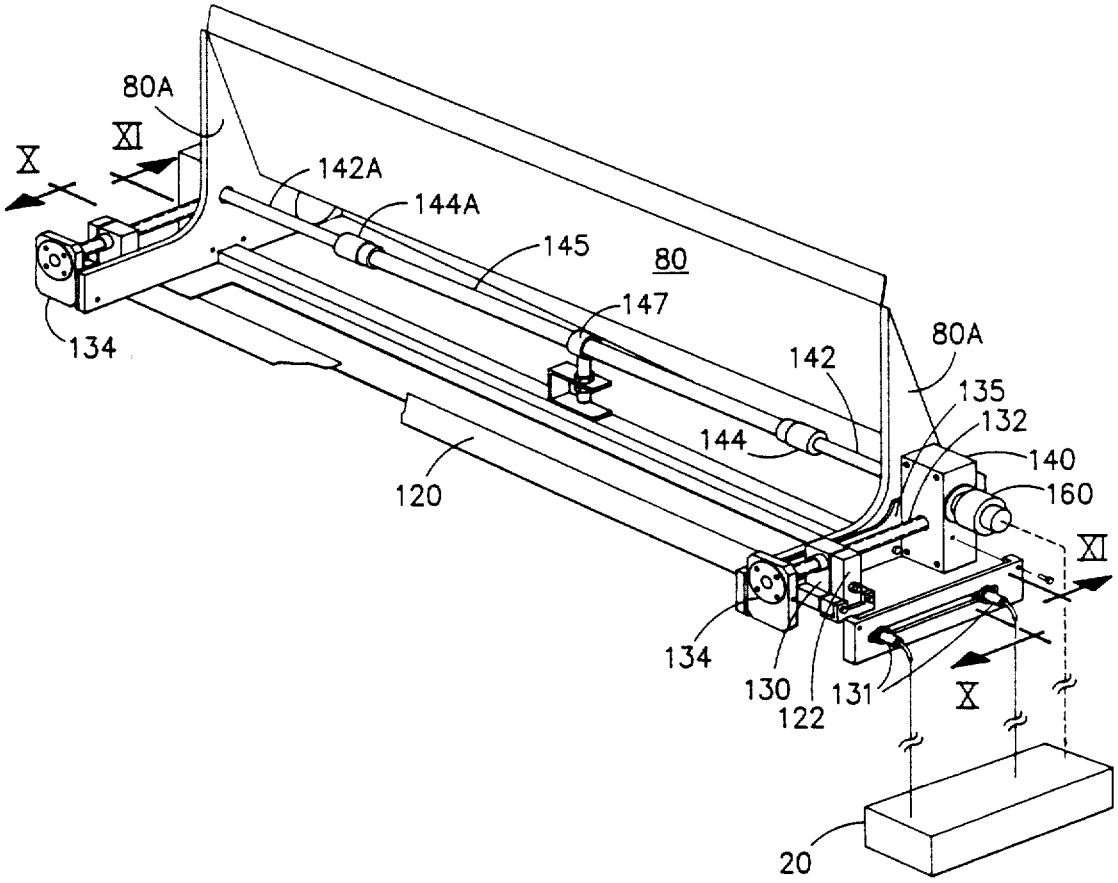
FIG. 9 is a perspective diagrammatic view of the shutter/containment apparatus of the instant invention, further showing a preferred means by which the shutter may be actuated.
Figure 10:
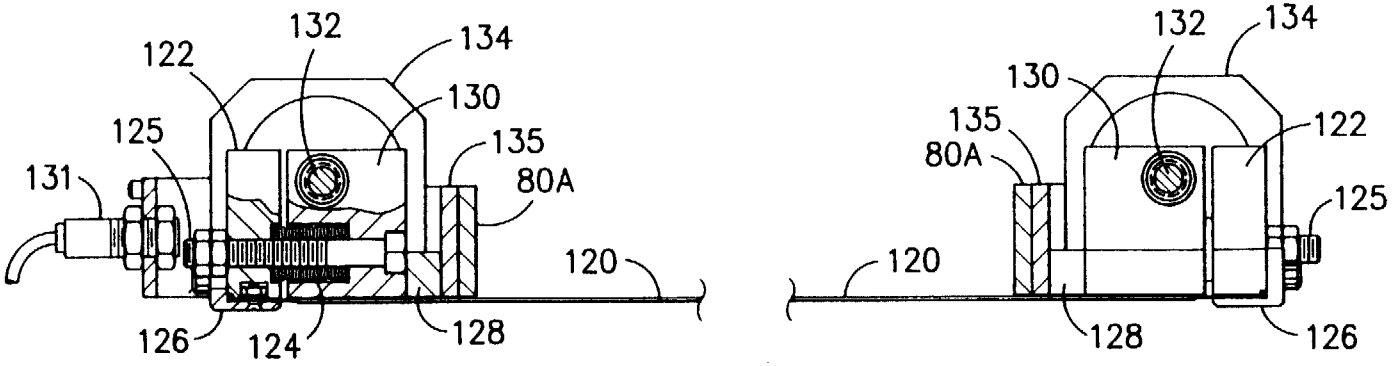
FIG. 10 is a view of the shutter/containment apparatus of FIG. 9, as seen along lines X—X of FIG. 9 with the left most shutter shuttle assembly shown in partial section.

As best shown in FIGS. 9 and 10, shield 120 extends under the side portions 80A of primary dye collection chamber 80, under a wear plate 128, and under shield shuttle 130, which contains an internal chamber suitable for accommodating a stack of opposing Bellville-type spring washers 124 surrounding a tensioning bolt 125. Tensioning bolt 125 also pass through pressure plate 122, to which is attached the end-most portion of shield 120, via a conventional clamp and screw arrangement shown generally at 126. This configuration provides for the controlled application of tension on shield 120 by the compression of washers 124, and also couples shield 120 to moveable shuttle 130. When shuttle 130 is driven along the length of rotating shuttle guide threaded shaft 132, as described in more detail below, shield 120 is constrained to follow, without change in the tension applied to shield 120.

Figure 3:
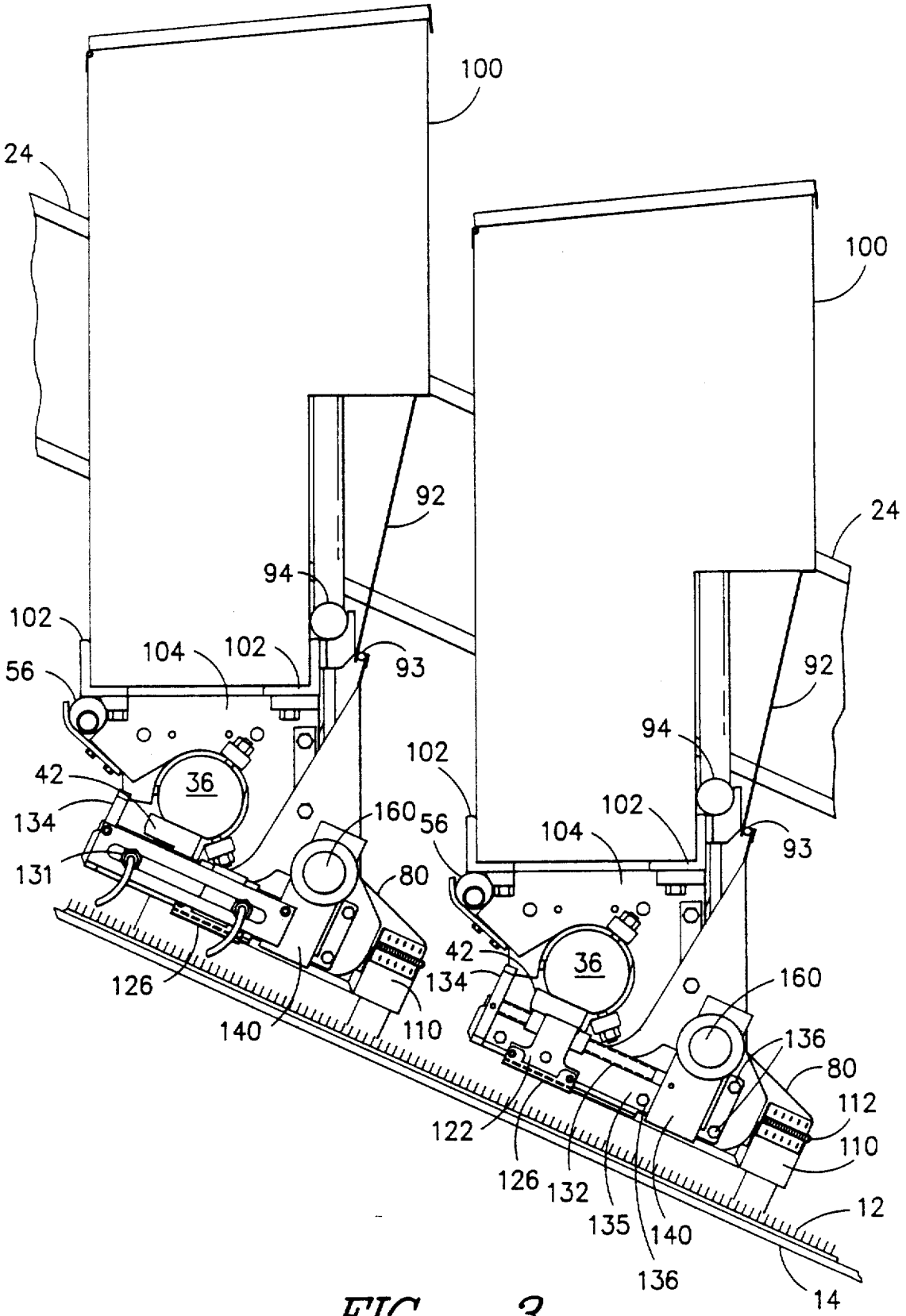
FIG. 3 is a diagrammatic side view of two of the arrays depicted in FIG. 1, in which the right array is shown with the shutter device of the instant invention in a closed or engaged position, while the left array is depicted with the shutter device in an open or disengaged position, and further is depicted with a set of proximity sensors in place to detect the position of the shutter device.
Figure 4:
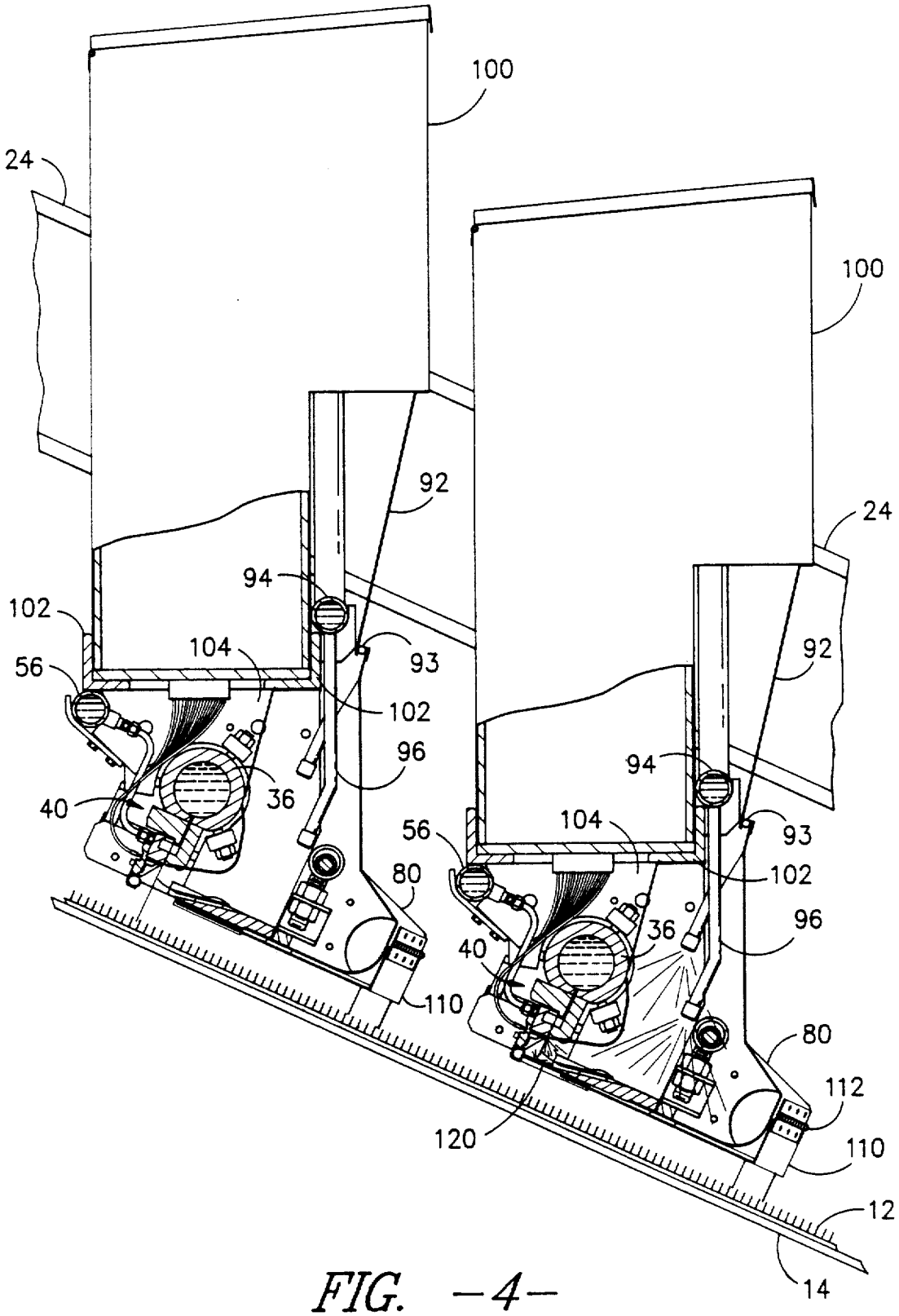
FIG. 4 is a view similar to FIG. 3, but taken along a vertical plane which intersects the array at an interior location, as depicted in FIG. 8 along line IV—IV, to show the interior of the arrays. The right array is depicted with a wash system engaged.

The means by which shield 120 may be reversibly and reliably moved from a "closed" to an "open" position (and vice versa) without skewing is best described with reference to FIGS. 3, 9, and 11. At each outside end of array 26, shield 120 is attached to a moveable shuttle 130 which is associated with shuttle guide threaded shaft 132, which extends alongside array 26 in a direction generally aligned with conveyor 14 within the region of dye outlets 52. Shuttle guide shaft 132 is supported at one end by shaft support plate and bearing 134 which allows for the free rotation of shaft 132. The opposite end of shuttle guide shaft 132 is supported by a gear box 140. Both shaft support plate 134 and gearbox 140 are permanently attached to gearbox mounting plate 135 which, in turn, is adjustably attached with bolts 136 to the end plates 80A of the primary dye collection chamber 80. If desired, a bellows or similar sleeve may be used to protect threaded shaft 132 from dirt, dyestuffs or other contaminants.

Figure 11:
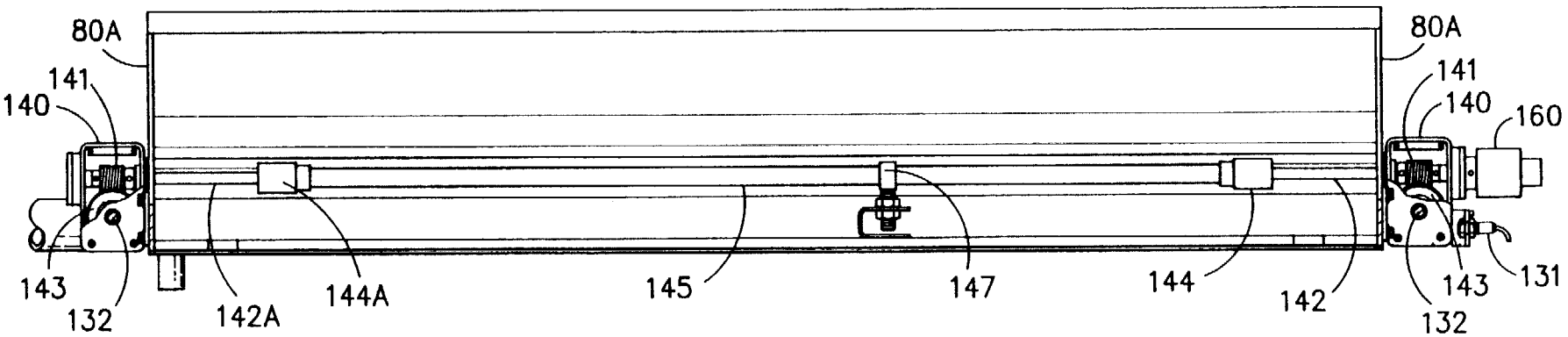
FIG. 11 is a view of the shutter/containment apparatus of FIG. 9, as seen along lines XI—XI of FIG. 9, with the gear boxes shown in partial section.

The gearboxes 140 on either side of the dye collection chamber 80 are connected together by a conventional flexible drive shaft assembly as better shown in FIGS. 7, 8, 9, and 11. The flexible drive shaft assembly consists of a spirally wound inner steel core 146 which rotates within and is protected by an impermeable casing 145. The steel core is rigidly attached at both ends to shaft couplings 144 and **144*a*. The flexible drive shaft assembly is supported near its midpoint by shaft alignment collar 147. As seen in FIG. 11, motor 160 is directly connected to rigid drive shaft 142 to which is also connected worm 141. Rotation of the motor 160 imparts a direct rotation of worm 141 which in turn drives worm gear 143 with a corresponding fixed speed reduction. Worm gear 143 is directly attached to the shuttle guide threaded shaft 132. The torque of motor 160 may therefore be enhanced by the combined mechanical advantages imparted by the worm gearing and the screw threads on threaded shaft 132, which threads serve to drive shuttle 130 (and shield 120) in the desired linear direction. Through the connection offered by the flexible drive shaft assembly, the gearboxes on each side of the array 26 are constrained to rotate in unison, which, in turn, synchronously propels the shuttle 130 on each side of the array in the direction appropriate to the direction of guide shaft 132 rotation. A particular advantage of this drive system is that it minimizes any skewing of the shield 120 due to movement of the ends of the shield 120 at different rates. A further advantage is the slow even movement of the shuttle 130** which does not impart vibration or shock to the sensitive dye manifold assembly.

Reversible motor 160 may use any appropriate type of drive; a pneumatic motor has been found to be particularly satisfactory in terms of size and reliability.

As depicted in FIG. 9, a set of inductive proximity switches 131 or the like may be adjustably positioned to detect the arrival of shuttle 130 at the desired end points of travel, and to disengage motor 160 as appropriate. Connecting proximity switches 131 and motor 160 to pattern control device 20 allows pattern control device 20 to sense the position of shield 120. It is intended, using such switches 131, that the motion of shield 120 may be controlled (i.e., both initiated and terminated) in response to the pattern data from pattern control device 20, as appropriate, thereby providing for the automatic cleaning/color changing of arrays which are no longer needed to produce a given pattern, in preparation for the production of a different pattern. The details of automatically and electronically changing from one pattern to another is set forth in U.S. Pat. No. 4,170,883, issued Oct. 16, 1979, which disclosure is hereby incorporated by reference.

What is claimed is:

1. Apparatus for applying liquids to a moving substrate comprising means for conveying the substrate in a predetermined path of travel, liquid applicator means having a row of outlets extending across and positioned above the substrate path for discharging a corresponding row of generally parallel, undeflected streams of liquid on a trajectory directed toward the substrate path, a source of electrically encoded pattern data, gas passage means positioned adjacent to said row of outlets and aligned with the discharge axes of the outlets for selectively deflecting, in accordance with pattern data from such data source, the trajectory of said streams of liquid emerging from said outlets with streams of gas from said gas passage means which intersect said streams of liquid, a liquid collection chamber positioned adjacent to said outlets and opposite from said gas passage means, said liquid collection chamber having an opening which extends along said row of outlets and which is positioned to receive said gas streams and liquid streams deflected by said gas streams and thereby prevent said streams from contacting said substrate, and a liquid containment barrier, said barrier being comprised of a movable shield which may be selectively interposed between said row of outlets and said substrate to prevent said parallel undeflected streams of liquid discharged from said outlets from contacting said substrate, or withdrawn to a position which allows said parallel undeflected streams to contact said substrate.

2. The apparatus of claim 1 wherein the movement of said shield is in response to data from said data source.

3. The apparatus of claim 1 wherein said moveable shield is an elongate thin plate.

4. The apparatus of claim 3 wherein said liquid containment barrier is further comprised of traversing gears at each end of said elongate plate, said gears being connected by a flexible shaft driven by a single source of mechanical power.

5. The apparatus of claim 3 wherein at least one end of said thin plate is associated with a tensioning device to induce tension along the length of said plate and thereby impart stiffness to said plate.

6. The apparatus of claim 3 wherein said liquid containment barrier is further comprised of a secondary liquid collection tray, which tray is positioned adjacent to and in overlapping relation with said thin plate, so that liquid accumulating on said plate may flow into said collection tray and is prevented from flowing onto said substrate.

7. The apparatus of claim 6 wherein one wall of said liquid collection chamber is substantially planar and is positioned substantially parallel to said streams of gas, wherein at least a portion of said secondary liquid collection tray is substantially planar and said planar portion is positioned opposite and in close proximity to, said planar wall of said liquid collection chamber and said planar portion of said secondary liquid collection tray thereby forming a slot, and wherein said thin plate comprising said moveable shield is positioned slightly within said slot when said shield is interposed between said outlets and said substrate, and deeply within said slot when said shield is in said withdrawn position.

* * * * *